US005927391A

United States Patent [19]

Chung

[11] Patent Number: 5,927,391

[45] Date of Patent: Jul. 27, 1999

[54] APPARATUS FOR COOLING A CONDENSER OF A ROOM AIR CONDITIONER

[75] Inventor: Sang-Hyeon Chung, Incheon, Rep. of Korea

[73] Assignee: Daewoo Electronics Co., Ltd., Seoul, Rep. of Korea

[21] Appl. No.: 09/086,515

[22] Filed: May 28, 1998

[30] Foreign Application Priority Data

May 29, 1997 [KR] Rep. of Korea ..... 97-21762

[51] Int. Cl.[6] ..... F28F 13/12

[52] U.S. Cl. ..... 165/123; 165/122; 62/429; 123/41.65; 415/176; 415/211.1

[58] Field of Search ..... 165/123, 122, 165/121; 123/41.49, 41.65; 180/68.1; 62/426, 428, 429; 415/223, 211.2, 211.1, 178, 176

[56] References Cited

U.S. PATENT DOCUMENTS

| | | | |
|---|---|---|---|
| 1,306,976 | 6/1919 | Searles | 165/121 |
| 1,576,833 | 3/1926 | Larsen | 165/122 |
| 2,186,837 | 1/1940 | McMahan | 165/122 |
| 3,795,274 | 3/1974 | Fieni | 165/122 |
| 3,840,067 | 10/1974 | Bos | 165/122 |
| 4,257,554 | 3/1981 | Willingham | 165/122 X |
| 4,909,311 | 3/1990 | Nakamura et al. | 123/41.49 X |
| 4,971,143 | 11/1990 | Hogan | 165/122 |
| 5,180,003 | 1/1993 | Kouzel et al. | 165/121 |
| 5,273,400 | 12/1993 | Amr . | |
| 5,660,149 | 8/1997 | Lakerdas et al. | 123/41.49 X |
| 5,706,672 | 1/1998 | Miyazaki . | |

FOREIGN PATENT DOCUMENTS

| | | | |
|---|---|---|---|
| 501079 | 2/1951 | Belgium | 165/122 |
| 0 738 857 | 10/1996 | European Pat. Off. . | |
| 1074321 | 1/1960 | Germany | 165/122 |
| 3432439 | 8/1985 | Germany | 123/41.49 |
| 1574859 | 6/1990 | U.S.S.R. | 123/41.49 |
| 2 167 851 | 6/1986 | United Kingdom . | |

*Primary Examiner*—Christopher Atkinson
*Attorney, Agent, or Firm*—Pillsbury Madison & Sutro LLP

[57] ABSTRACT

Apparatus for cooling a condenser of a room air conditioner. The apparatus has a first fan coupled to a driving shaft of a driving motor, a second fan which has a circular band and is coupled to an edge portion of the driving shaft for accelerating air blown by the first fan, a skirt member for guiding the air accelerated by the second fan toward a center portion of the condenser, a mounting flange assembled to the condenser, and fixing members for fixing the skirt member to the mounting flange. The circular band surrounding the first fan converges toward the condenser and the skirt member is flared toward the condenser so that air passing through the second fan is accelerated toward the center portion of the condenser and experiences a minimum pressure drop. Air flowing along an outer wall of the skirt member cools a circumferential portion of the condenser. The apparatus uniformly cools the condenser, thereby improving an air conditioning efficiency of the room air conditioner.

6 Claims, 6 Drawing Sheets

100

200

APPARATUS FOR COOLING A CONDENSER OF A ROOM AIR CONDITIONER

BACKGROUND OF THE INVENTION

1. Field of the Invention

The present invention relates to a room air conditioner, and more particularly to an apparatus for cooling a condenser of a room air conditioner which can improve a cooling efficiency of the condenser.

2. Description of the Prior Art

Generally, an air conditioner is an apparatus for conditioning air in a house or an office with a properly adjusted indoor temperature and humidity agreeable to a human body. In practice, the air conditioner may be controlled to keep an indoor temperature of about 28° C. and an indoor humidity of about 65–75% during hot summer days, while keeping the indoor temperature of about 18° C. and the indoor humidity of about 55–70% during cold winter days.

In such an air conditioner, and especially in a room air conditioner, all the operative components thereof are assembled in one unit. Within the room air conditioner unit, an evaporator and an exhaust grill sections for uniformly dispersing the conditioned air to a room are positioned toward the room, and a condenser part which is super-heated during its operation is extended out of the room so as to be cooled by outdoor air.

FIGS. 1 and 2 show an exterior appearance and a structure of a conventional room air conditioner 100. Referring to FIGS. 1 and 2, conventional room air conditioner 100, to perform refrigeration cycles, has a compressor 1 for compressing a refrigerant gas with a high pressure and a high temperature, a condenser 2 for gradually condensing the high temperature and high pressure refrigerant gas transferred from compressor 1 to a liquid phase by a heat exchange, an expansion valve 3 for reducing the pressure of the liquid-phase refrigerant transferred from condenser 2 to change the liquid-phase refrigerant to a low temperature refrigerant in a multiphase of liquid-gas, and an evaporator 4 for evaporating the low temperature multiphase refrigerant with an absorption of environmental heat and transferring the evaporated refrigerant gas to compressor 1.

Conventional room air conditioner 100 further has a base plate 5 for supporting all of the operative components thereon, first and second isolation wall sections 6 and 7 vertically mounted on base plate 5 with predetermined intervals to separate the evaporator part from the condenser part, a driving motor 9 fixed to a motor mount 8 which is vertically assembled on base plate 5, located between first and second isolation wall sections 6 and 7 a blower 10 and a fan 11 fixed to both driving shafts 9*a* and 9*b* of driving motor 9, a control unit 12 assembled on first isolation wall section 6 for the control of the room temperature, a grill section 13 assembled in front of first isolation wall section 6 for allowing indoor air to pass therethrough and uniformly dispersing the conditioned air to a room, and a cap member 14 mounted on base plate 5 to cover all the operative components mounted on base plate 5.

First isolation wall section 6 has a barrier 51 vertically assembled on base plate 5 to separate and isolate the evaporator part from the condenser part, a scroll 52 assembled with base plate 5 and barrier 51 for guiding the circulation of the air which is drawn by blower 10 and conditioned through evaporator 4 to the room and for gathering a condensate falling from evaporator 4 for a drainage out of the unit , an evaporator cover 53 assembled with scroll 52 for guiding the circulation of the conditioned air to the room in cooperation with scroll 52 so that the conditioned air is expelled through grill section 13, a brace 54 assembled with second isolation wall section 7 and barrier 51 for providing a support between first and second isolation wall sections 6 and 7 at predetermined intervals, and fixing members 55 assembled on a lower part of scroll 52 to fix a temperature sensor (not shown) for sensing the temperature of the drawn indoor air.

Second isolation wall section 7 has a structure assembled on base plate 5 to separate and isolate the condenser part from the evaporator part. Second isolation wall section 7 guides the outdoor air drawn by fan 11 so that the drawn air passes through condenser 2 and then is expelled outside thereof.

An air conditioning efficiency of room air conditioner 100 depends on a cooling efficiency of condenser 2. As shown in FIG. 2, in room air conditioner 100, fan 11 is coupled to a driving shaft 9*b* so as to rotate therewith. The outside air drawn by a rotation of fan 11 passes around condenser 2 positioned in front of fan 11, makes a heat exchange with the refrigerant flowing in condenser 2, and is expelled outside thereof.

Meanwhile, U.S. Pat. No. 5,273,400 discloses a fan shroud and a fan orifice. FIGS. 3A and 3B show front and side views of the fan shroud and the fan orifice. As shown in FIGS. 3A and 3B, fan shroud 125 is fixed along tips of a plurality of blades 113 formed at fan 110 so as to rotate therewith. Fan orifice 131 having a shape corresponding to a shape of a circumferential portion of fan shroud 125 is formed through an orifice bulkhead 130 in such a manner that fan orifice 131 is positioned adjacent to fan shroud 125, thereby guiding the air toward fan 110.

However, in the condenser cooling mechanism as described above, the air blown by fan 11 toward condenser 2 is radially dispersed, so the air does not pass through a center portion of condenser 2, but passes only a circumferential portion of condenser 2. Consequently, a cooling efficiency of condenser 2 is decreased, and the refrigerant in condenser 2 is not uniformly cooled, so the refrigerant flow becomes unstable. Accordingly, an air conditioning efficiency of room air conditioner 100 is decreased. Therefore, there is a need to provide an orifice or a guiding member between fan 11 and condenser 2 to make air pass through the center portion of condenser 2.

SUMMARY OF THE INVENTION

The present invention is intended to overcome the above-described disadvantages. Therefore, it is an object of the present invention to provide an apparatus for cooling a condenser of a room air conditioner which can improve a cooling efficiency of the condenser so that a conditioning efficiency of the room air conditioner is improved.

In order to achieve the above object of the present invention, there is provided an apparatus for cooling a condenser of a room air conditioner, which comprises:

a first fan coupled to a predetermined position of a driving shaft extending from a driving motor toward a condenser for blowing air toward the condenser while the driving motor is being operated;

a first means for accelerating some of the air blown by the first fan toward the condenser;

a second means for guiding the air accelerated by the first means to a center portion of the condenser.

The first means includes a second fan coupled to an edge portion of the driving shaft of the driving motor, the second fan being positioned in front of the first fan with respect to the condenser, drawing air in an inner core portion of an air-stream generated by the first fan and forwardly accelerating the air drawn.

According to a preferred embodiment of the present invention, the second fan is smaller in size than the first fan.

The second fan includes a hub having a cylindrical shape which is disposed around the edge portion of the driving shaft, a plurality of blades radially extending from the hub, and a circular band which has a predetermined width and surrounds tips of the blades.

According to a preferred embodiment of the present invention, the circular band is skewed in such a manner that the circular band converges toward the condenser so as to accelerate air passing through the second fan toward the condenser.

The second means includes a skirt member having a first opening having a shape corresponding to a shape of a circumferential edge of the circular band adjacent to the condenser, a mounting flange assembled along a circumferential edge of the condenser, and a plurality of fixing members for fixing the skirt member to the mounting flange, a circumferential edge of a second opening of the skirt member oppositely positioned to the first opening being fixed to the mounting flange by the fixing members.

According to a preferred embodiment of the present invention, the skirt member is flared from the first opening thereof to the second opening thereof so as to prevent air passing therethrough from being separated from an inner wall thereof, thereby minimizing a pressure loss thereof.

The skirt member is radially and outwardly formed at the circumferential edge of the second opening thereof with a plurality of ribs which are spaced apart from each other, each fixing member being fixed at a first end thereof to each rib and being fixed at a second end thereof opposite to the first end to a predetermined position of the mounting flange so as to stably fix the skirt member to the mounting flange.

According to a preferred embodiment of the present invention, the second means includes four fixing members, the second ends of fixing members being fixed to corner portions of the mounting flange having a rectangular shape, respectively, so that the skirt member is stably fixed to the mounting flange.

According to a preferred embodiment of the present invention, the circular band is inserted into the skirt member by a predetermined length and has a predetermined radial tolerance with the skirt member so as to minimize a pressure loss of an air flow generated by the second fan, thereby facilitating a cooling of the center portion of the condenser.

The apparatus for cooling a condenser of a room air conditioner according to the present invention can effectively cool a center portion of the condenser so that a cooling efficiency of the condenser is improved, thereby improving a conditioning efficiency of the room air conditioner.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a room air conditioner 200 having an apparatus 300 for cooling a condenser according to a preferred embodiment of the present invention will be explained in more detail with reference to the accompanying drawings.

Figure 1:
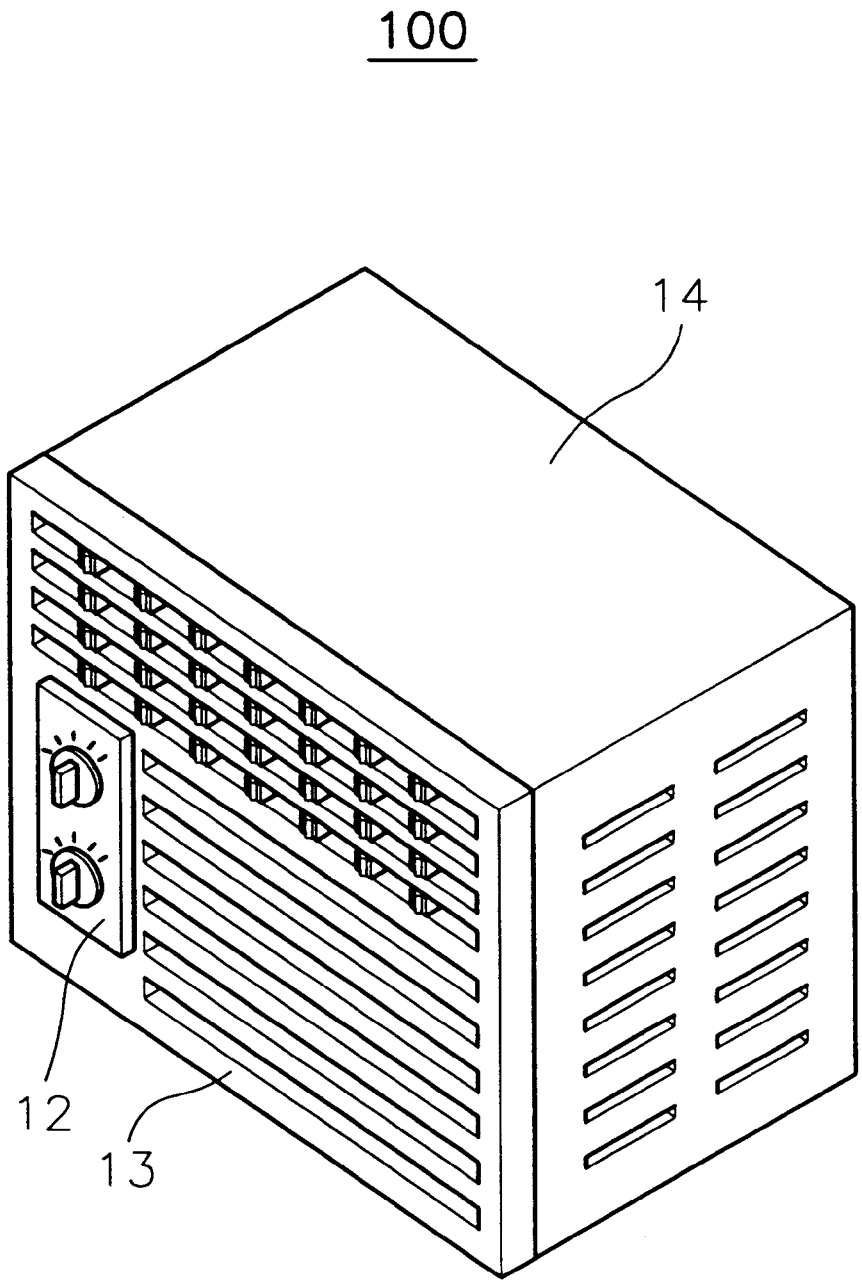
FIG. 1 (PRIOR ART)
FIG. 1 is a perspective view of a conventional room air conditioner.
Figure 2:
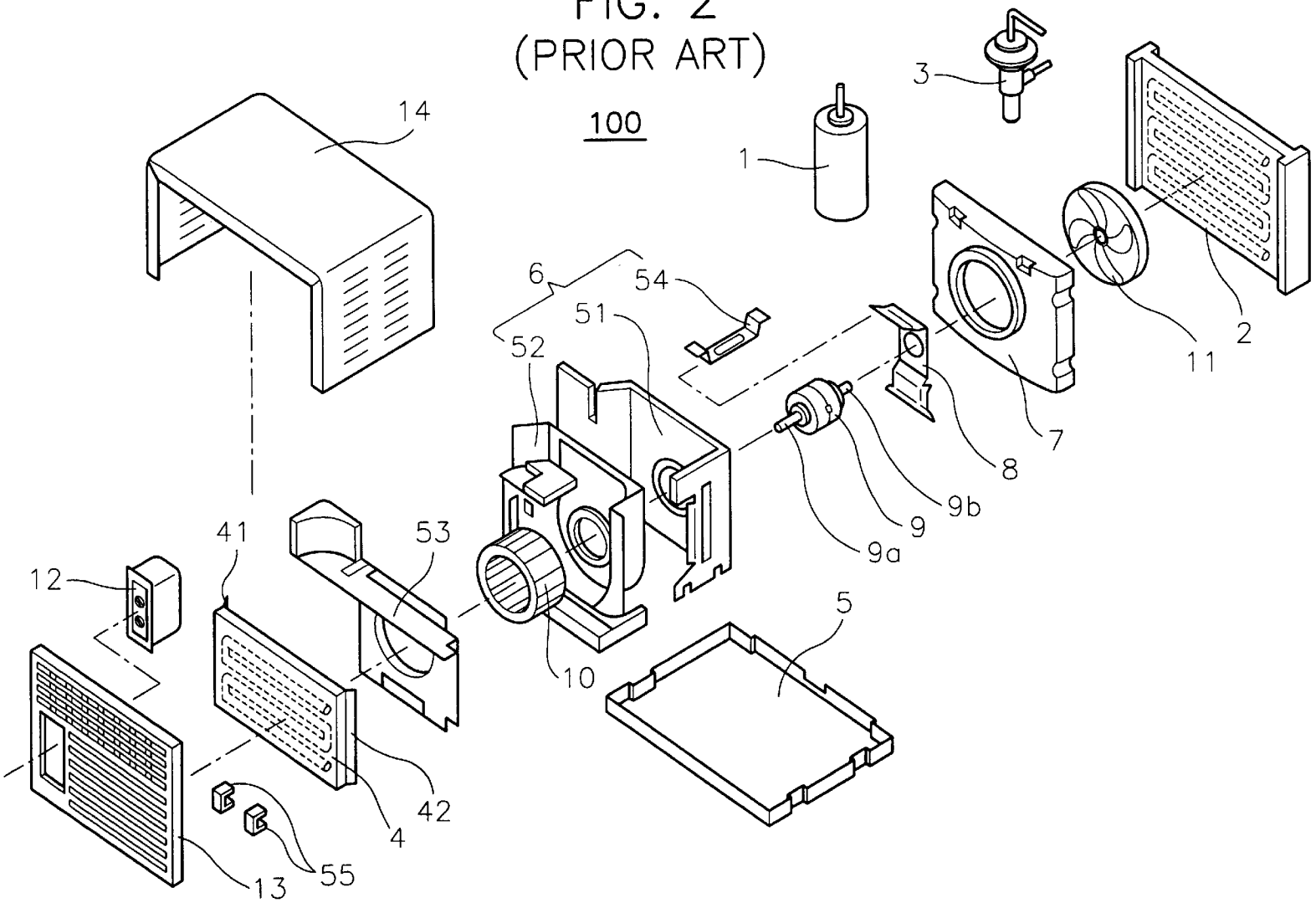
FIG. 2 (PRIOR ART)
FIG. 2 is an exploded perspective view of the conventional room air conditioner.
Figure 3A:
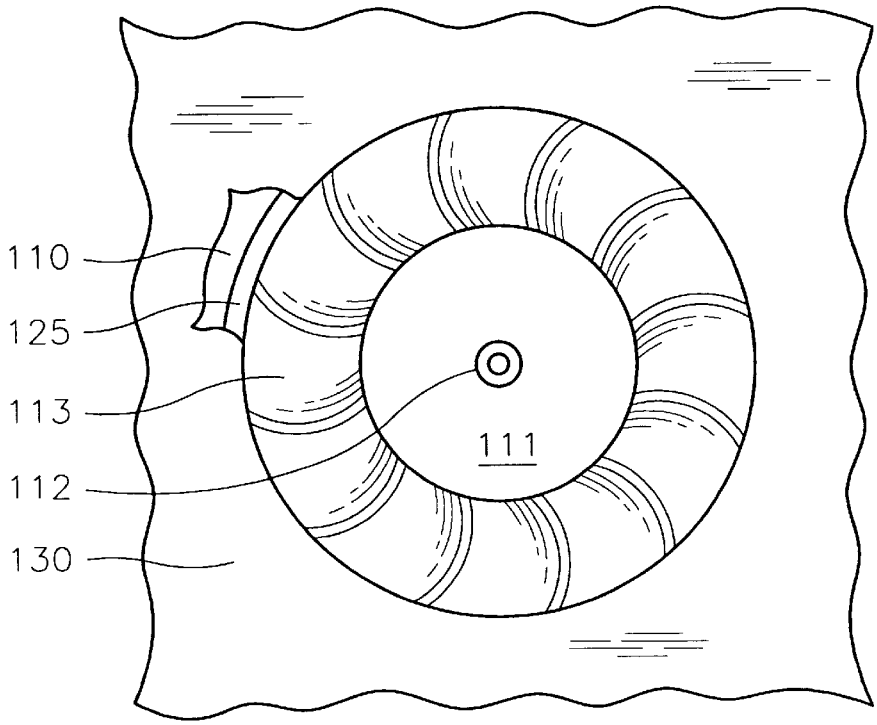
FIG. 3A (PRIOR ART)
FIGS. 3A and 3B are front and side views of a fan shroud and a fan orifice of a conventional art, respectively.
Figure 3B:
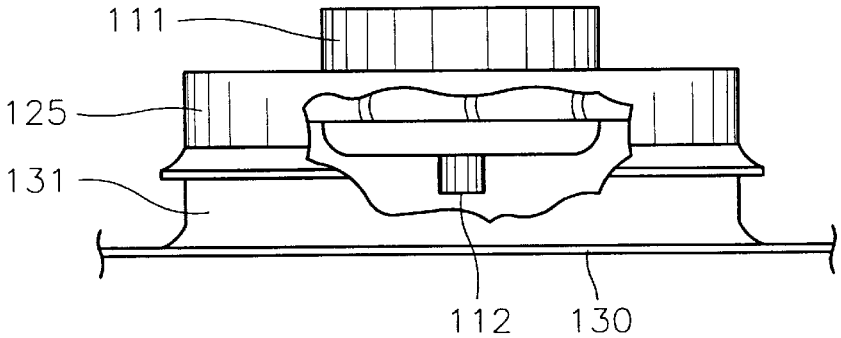
FIG. 3B (PRIOR ART)
Figure 4:
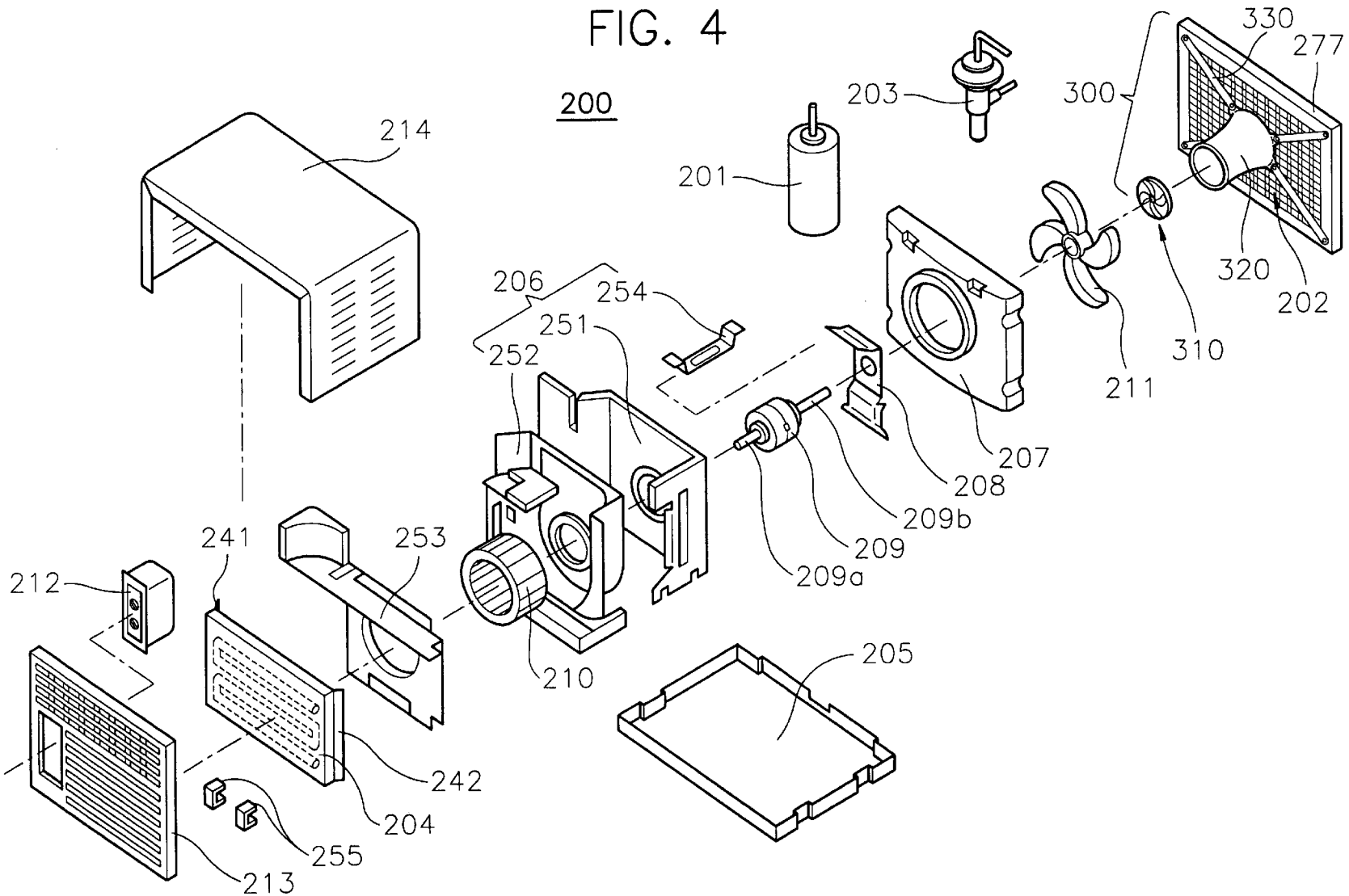
FIG. 4 is an exploded perspective view of a room air conditioner having an apparatus for cooling a condenser according to a preferred embodiment of the present invention.
Figure 6:
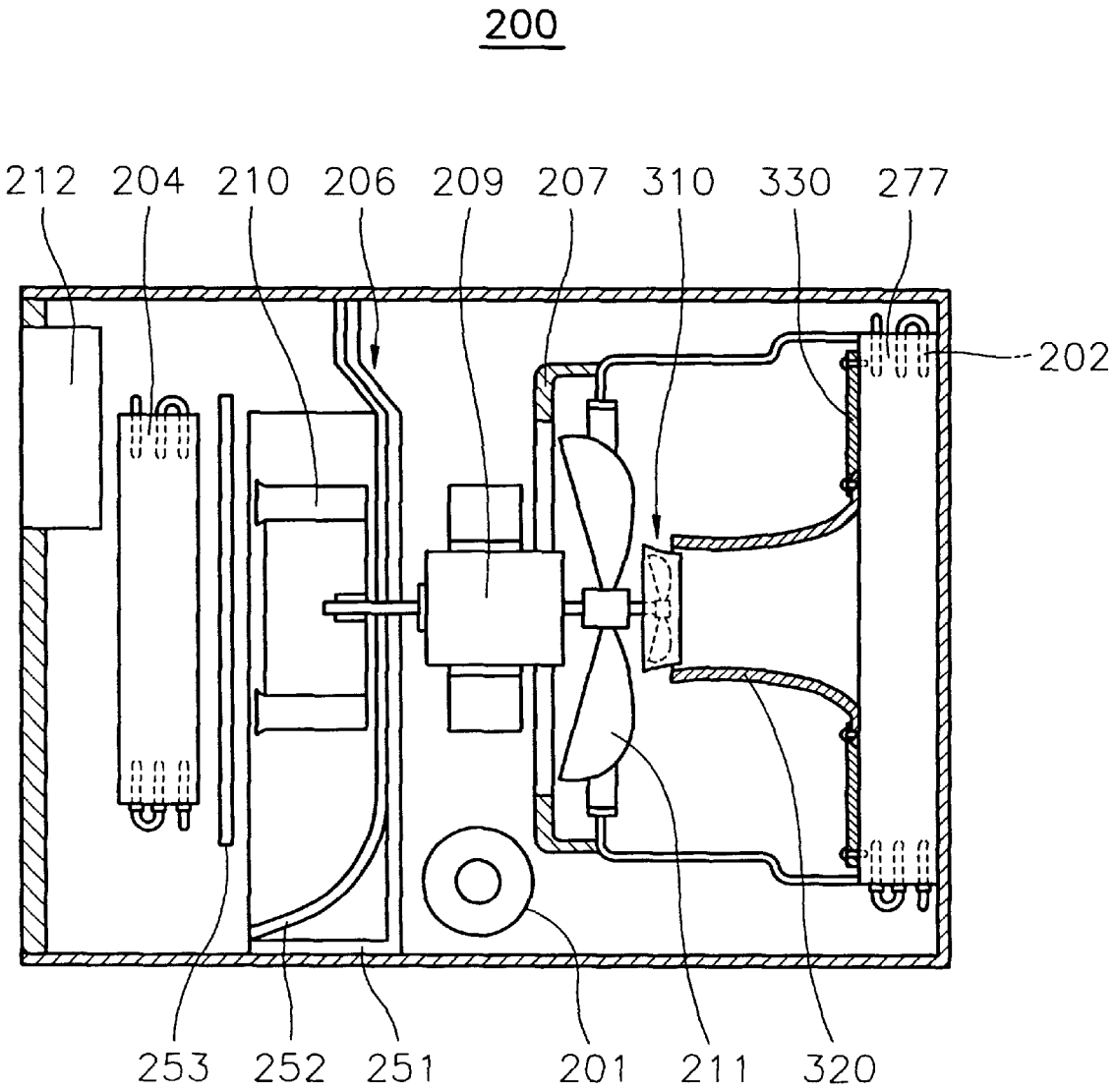
FIG. 6 is a plane sectional view of the room air conditioner according to the present invention.

FIGS. 4 and 6 show room air conditioner 200 having an apparatus 300 for cooling a condenser according to the present invention.

Figure 5:
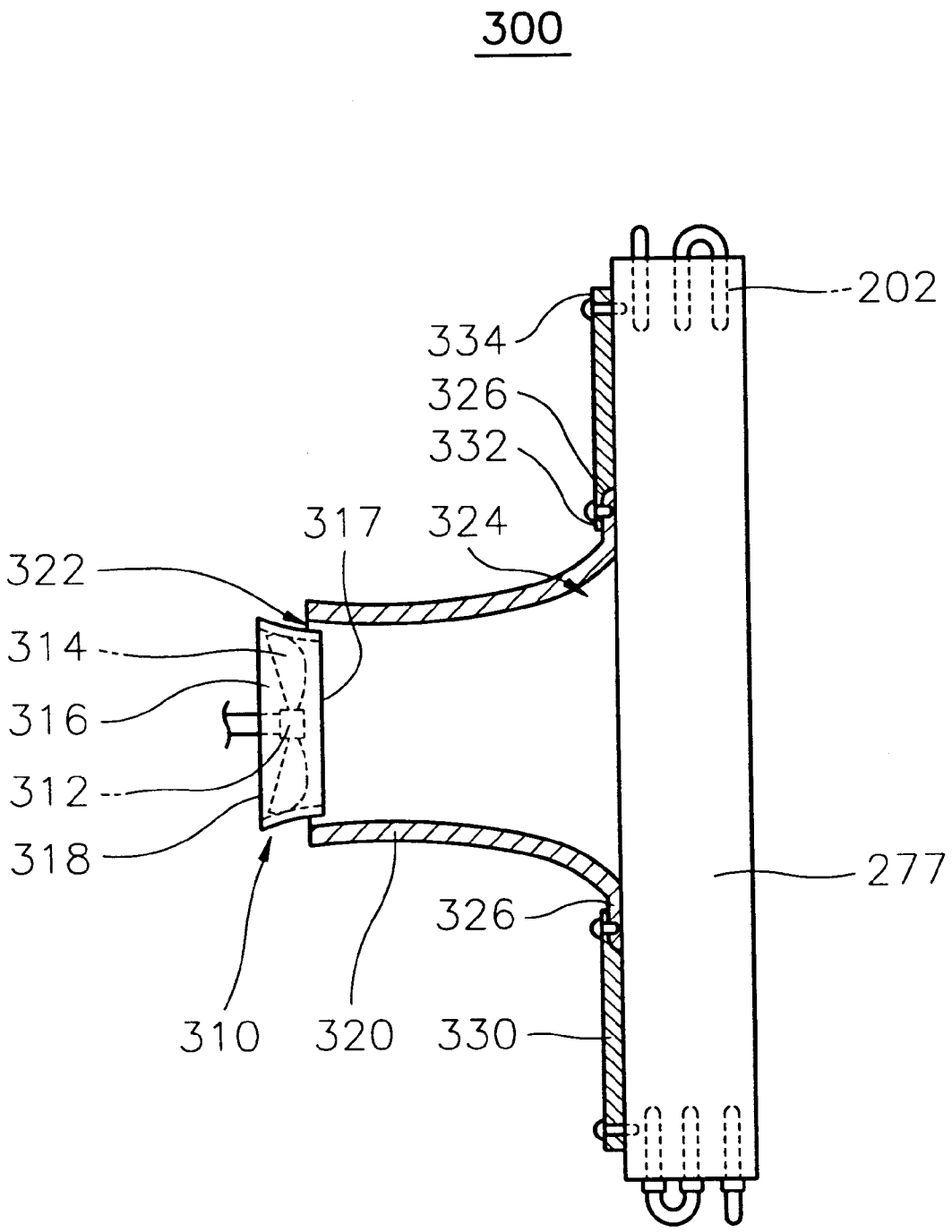
FIG. 5 is an exploded perspective view of the apparatus for cooling a condenser according to a preferred embodiment of the present invention shown in FIG. 4.

As shown in FIGS. 4 to 6, within room air conditioner 200, an evaporator 204 and a grill sections 213 for uniformly dispersing a conditioned air to a room are positioned toward the room, and a condenser part is extended out of the room so as to be cooled by outdoor air.

Room air conditioner 200, to perform refrigeration cycles, has a compressor 201 for compressing refrigerant gas with a high pressure and a high temperature, a condenser 202 for gradually condensing the high temperature and high pressure refrigerant gas transferred from compressor 201 to a liquid phase by heat radiation, an expansion valve 203 for reducing the pressure of the liquid-phase refrigerant transferred from condenser 202 to change the liquid-phase refrigerant to a low temperature refrigerant in a multiphase of liquid-gas, and an evaporator 204 for evaporating the low temperature multiphase refrigerant with an absorption of environmental heat and transferring the evaporated refrigerant gas to compressor 201.

Room air conditioner 200 further has a base plate 205 for supporting all of the operative components thereon, first and second isolation wall sections 206 and 207 vertically mounted on base plate 205 with predetermined intervals to separate the evaporator part from the condenser part, a driving motor 209 fixed to a motor mount 208 which is vertically assembled on base plate 205 and is located between first and second isolation wall sections 206 and 207, a blower 210 and a fan 211 fixed to both ends of driving shaft 209*a* of driving motor 209, a control unit 212 assembled at first isolation wall section 206 for the control of the room temperature, a grill section 213 assembled in front of first isolation wall section 206 for allowing indoor air to pass therethrough and uniformly dispersing the conditioned air to a room, and a cap member 214 mounted on base plate 205 to cover all the operative components mounted on base plate 205.

First isolation wall section 206 has a barrier 251 vertically assembled on base plate 205 to separate and isolate the evaporator part from the condenser part, a scroll 252 assembled with base plate 205 and barrier 251, for guiding the circulation of the air drawn by blower 210 and conditioned through evaporator 204 to the room and gathering condensate collected from evaporator 204 for the drainage out of the unit, an evaporator cover 253 assembled with scroll 252 for guiding the circulation of the conditioned air to the room in cooperation with scroll 252 so that the conditioned air is expelled through grill section 213, a brace 254 assembled with second isolation wall section 207 and barrier 251 for providing a support between first and second isolation wall section 206 and 207 at predetermined interval, and fixing members 255 assembled on a lower part of scroll 252 to fix a temperature sensor (not shown) for sensing the temperature of the drawn indoor air.

Second isolation wall section 207 has a structure assembled on base plate 205 to separate and isolate the condenser part from the evaporator part. Second isolation wall section 207 guides the outdoor air drawn by a first fan 211 so that the drawn air passes through condenser 202 and then is expelled outside thereof.

Hereinafter, an apparatus 300 for cooling a condenser according to a preferred embodiment of the present invention will be described with reference to FIGS. 4 and 5.

First fan 211 is coupled to a predetermined position of driving shaft 209*b* extending from driving motor 209 secured to a motor mount 208 installed at base plate 205. First fan 211 rotates so as to blow air toward condenser 202 while driving motor 209 is being operated.

In cooperation with first fan 211, for blowing the air toward a center portion of condenser 202, apparatus 300 for cooling condenser 202 according to a preferred embodiment of the present invention is provided. Condenser cooling apparatus 300 includes a second fan 310 coupled to an edge portion of driving shaft 209*b* of driving motor 209. That is, second fan 310 is positioned in front of first fan 211 with respect to condenser 202. While driving motor 209 is being operated, second fan 310 draws air in an inner core portion of an air-stream generated by first fan 211 and forwardly accelerates the air drawn to condenser 202. According to a preferred embodiment of the present invention, second fan 310 is smaller in size than first fan 211 in order to properly cool the center portion of condenser 202 which cannot be cooled enough only by first fan 211.

Second fan 310 includes a hub 312 having a cylindrical shape which is disposed around the edge portion of driving shaft 209*b*, a plurality of blades 314 radially extending from hub 312, and a circular band 316 which has a predetermined width and surrounds tips of blades 314.

According to a preferred embodiment of the present invention, circular band 316 is skewed in such a manner that circular band 316 converges toward condenser 202 so as to accelerate air passing therethrough.

In order to guide the air accelerated by second fan 310 toward the center portion of condenser 202, a skirt member 320 having a first opening 322 having a shape corresponding to a shape of a circumferential edge 317 of circular band 316 adjacent to condenser 202 is provided between first fan 310 and condenser 202. On the other hand, a mounting flange 277 is assembled along a circumferential edge portion of condenser 202 and surrounds condenser 202. A plurality of fixing members 330 for fixing skirt member 320 to mounting flange 277 are provided. A circumferential edge portion of a second opening 324 of skirt member 320 oppositely positioned to first opening 322 is fixed to mounting flange 277 by fixing members 330.

According to a preferred embodiment of the present invention, skirt member 320 is flared from first opening 322 thereof to second opening 324 thereof. Accordingly, air passing through skirt member 320 is not separated from an inner wall of skirt member 320, thereby minimizing a pressure loss thereof.

Skirt member 320 is radially and outwardly formed at the circumferential edge of second opening 324 thereof with a plurality of ribs 326 which are spaced apart from each other. Preferably, the number of ribs 326 are four which are spaced apart from each other by an interval of 90 degrees. Each fixing member 330 is fixed at a first end 332 thereof to each rib 326 and is fixed at a second end 334 thereof opposite to first end 332 to a predetermined position of mounting flange 277 so as to stably fix skirt member 320 to mounting flange 277. According to a preferred embodiment of the present invention, second ends 334 of fixing members 330 are fixed to four corner portions of mounting flange 277 of rectangular shape, respectively, so that skirt member 320 is stably fixed to mounting flange 277.

According to a preferred embodiment of the present invention, circular band 316 is inserted into skirt member 320 by a predetermined length and has a predetermined radial tolerance with skirt member 320 so as to minimize a pressure loss of an air flow generated by second fan 310, thereby facilitating a cooling of the center portion of condenser 202.

Hereinafter, the operation of room air conditioner 200 having condenser cooling apparatus 300 will be described with reference to the accompanying drawings.

When driving motor 209 is actuated, driving shafts 209*a* and 209*b* extending forward and rearward respectively from driving motor 209 rotate simultaneously. Blower 210 coupled to driving shaft 209*a* extending toward the evaporator part rotates and draws an indoor air. The air conditioned through evaporator 204 is guided toward the room by scroll 252. A condensate generated from evaporator 204 is drained out of room air conditioner 200 by scroll 252. Evaporator cover 253 in cooperation with scroll 252 guides the conditioned air so as to expel the conditioned air toward the room through grill section 213.

On the other hand, first and second fans 211 and 310 coupled to driving shaft 209*b* extending from driving motor 209 toward the condenser part rotate together. At this time, an outdoor air drawn into the condenser part is guided along second isolation wall section 207 so as to be sucked by first fan 211 and expelled in a forward direction thereof. Second fan 310 sucks some of the air expelled by first fan 211 and accelerates the same toward the center portion of condenser 202 through skirt member 320. At this time, the air passing through second fan 310 is accelerated toward the condenser part by skewed circular band 316.

In detail, the air accelerated by second fan 310 flows into skirt member 320 through first opening 322 and guided to the center portion of condenser 202 along an inner wall of skirt member 320. At this time, the air flow does not separated from the inner wall of skirt member 320 which has a proper curvature, so a pressure drop occurring in the air flow is minimized.

Also, since circular band 316 is inserted into skirt member 320 by a predetermined length, the air blown by second fan 310 experiences a minimum pressure drop so as to effectively cool the center portion of condenser 202.

Meanwhile, the rest of the air blown by first fan 211 which does not flow into skirt member 320 flows along an outer wall of skirt member 320 and cools a circumferential portion of condenser 202. Therefore, condenser 202 is uniformly cooled by first and second fans 211 and 310 so that the cooling efficiency of condenser 202 is maximized.

As described above, the apparatus for cooling a condenser of a room air conditioner according to the present invention can effectively cool a center portion of the condenser so that a cooling efficiency of the condenser is improved, thereby improving a conditioning efficiency of the room air conditioner.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. An apparatus for cooling a condenser of a room air conditioner, the apparatus comprising:

a first fan coupled to a predetermined position of a driving shaft extending from a driving motor toward a condenser, the first fan blowing air toward the condenser while the driving motor is being operated;

a first means for accelerating some portion of the air blown by the first fan and introducing the accelerated air toward the condenser, the first means including a second fan coupled to an end portion of the driving shaft and being smaller than the first fan, the second fan being positioned in front of the first fan with respect to the condenser, drawing and accelerating air in an inner core portion of an air-stream generated by the first fan, the second fan including a hub having a cylindrical shape which is disposed around the end portion of the driving shaft, a plurality of blades radially extending from the hub, and a circular band which has a predetermined width and surrounds tips of the blades, the circular band being skewed in such a manner that the circular band converges toward the condenser so as to accelerate the air passing therethrough toward the condenser; and a second means for guiding the air accelerated by the first means to a center portion of the condenser.

2. The apparatus as recited in claim 1, wherein the second means includes a skirt member having a first opening having a shape corresponding to a shape of a circumferential edge of the circular band adjacent to the condenser, a mounting flange assembled along a circumferential edge of the condenser, and a plurality of fixing members for fixing the skirt member to the mounting flange, a circumferential edge of a second opening of the skirt member being fixed to the mounting flange by the fixing members, the second opening being oppositely positioned to the first opening.

3. The apparatus as recited in claim 2, wherein the skirt member is flared from the first opening thereof to the second opening thereof so as to prevent air passing therethrough from being separated from an inner wall thereof, thereby minimizing a pressure drop thereof.

4. The apparatus as recited in claim 2, wherein the skirt member is radially and outwardly formed at the circumferential edge of the second opening thereof with a plurality of ribs which are spaced apart from each other, each fixing member being fixed at a first end thereof to each rib and being fixed at a second end thereof opposite to the first end to a predetermined position of the mounting flange so as to stably fix the skirt member to the mounting flange.

5. The apparatus as recited in claim 4, wherein the second means includes four fixing members, the second ends of the fixing members being fixed to corner portions of the mounting flange having a rectangular shape, respectively, so that the skirt member is stably fixed to the mounting flange.

6. The apparatus as recited in claim 2, wherein the circular band is inserted into the skirt member by a predetermined length and has a predetermined radial tolerance with the skirt member so as to minimize a pressure drop of an air flow generated by the second fan, thereby facilitating a cooling of the center portion of the condenser.

* * * * *